US010494850B2

(12) United States Patent
Liang et al.

(10) Patent No.: US 10,494,850 B2
(45) Date of Patent: Dec. 3, 2019

(54) HINGE

(71) Applicants: KING SLIDE WORKS CO., LTD., Kaohsiung (TW); KING SLIDE TECHNOLOGY CO., LTD., Kaohsiung (TW)

(72) Inventors: Hsiu-Chiang Liang, Kaohsiung (TW); Ken-Ching Chen, Kaohsiung (TW); Chun-Chiang Wang, Kaohsiung (TW)

(73) Assignees: King Slide Works Co., Ltd., Kaohsiung (TW); King Slide Tehcnology Co., Ltd., Kaohsiung (TW)

( * ) Notice: Subject to any disclaimer, the term of this patent is extended or adjusted under 35 U.S.C. 154(b) by 26 days.

(21) Appl. No.: 15/888,224

(22) Filed: Feb. 5, 2018

(65) Prior Publication Data

US 2018/0355651 A1 Dec. 13, 2018

(30) Foreign Application Priority Data

Jun. 8, 2017 (TW) ..... 106119376 A

(51) Int. Cl.

| | |
|---|---|
| ***E05F 1/08*** | (2006.01) |
| ***E05F 3/20*** | (2006.01) |
| ***E05D 11/10*** | (2006.01) |
| ***E05F 5/00*** | (2017.01) |
| ***E05D 11/00*** | (2006.01) |
| *E05F 1/12* | (2006.01) |

(Continued)

(52) U.S. Cl.

CPC ..... *E05F 3/20* (2013.01); *E05D 11/00* (2013.01); *E05D 11/1014* (2013.01); *E05D 11/1021* (2013.01); *E05F 5/006* (2013.01); *E05D 3/02* (2013.01); *E05D 5/065* (2013.01); *E05F 1/1215* (2013.01); *E05Y 2201/21* (2013.01); *E05Y 2201/25* (2013.01); *E05Y 2201/256* (2013.01); *E05Y 2201/264* (2013.01); *E05Y 2201/41* (2013.01); *E05Y 2201/484* (2013.01); *E05Y 2600/12* (2013.01); *E05Y 2600/14* (2013.01); *E05Y 2600/41* (2013.01); *E05Y 2600/60* (2013.01); *E05Y 2900/20* (2013.01)

(58) Field of Classification Search

CPC . Y10T 16/5383; Y10T 16/61; E05Y 2900/20; E05Y 2900/202; E05Y 2900/204; E05Y 2900/208; E05Y 2201/20; E05Y 2201/21; E05Y 2201/264; E05F 5/006; E05F 5/02; E05F 3/10; E05D 11/1021; E05D 11/1042; E05D 11/105; E05D 11/1064; E05D 7/04; E05D 7/0407; E05D 7/125; E05D 3/142; F16F 9/368; F16F 9/50; F16F 9/19; F16F 2228/001; F16F 2228/066; F16J 15/002

See application file for complete search history.

(56) References Cited

U.S. PATENT DOCUMENTS 5,524,323 A * 6/1996 Lin ..... E05D 5/08 16/235

8,387,213 B2 3/2013 Brunnmayr (Continued)

*Primary Examiner* — Chuck Y Mah

(74) *Attorney, Agent, or Firm* — Rosenberg, Klein & Lee

(57) ABSTRACT

A hinge includes a hinge arm, a hinge cup, at least one resilient member, and a retaining member. The hinge cup is pivotally connected with respect to the hinge arm and includes a receiving room. The resilient member is mounted in the receiving room of the hinge cup. The retaining member is mounted at the resilient member.

18 Claims, 13 Drawing Sheets

(51) Int. Cl.
*E05D 3/02* (2006.01)
*E05D 5/06* (2006.01)

(56) References Cited

U.S. PATENT DOCUMENTS

| | | | | |
|---|---|---|---|---|
| 8,561,262 | B1 | 10/2013 | Liang et al. | |
| 8,572,810 | B2 | 11/2013 | Brunnmayr | |
| 8,650,262 | B2 * | 2/2014 | Archer | G06F 9/541 709/217 |
| 8,650,711 | B1 * | 2/2014 | Chen | E05F 5/006 16/286 |
| 8,661,620 | B2 | 3/2014 | Brunnmayr | |
| 8,667,647 | B2 | 3/2014 | Brunnmayr | |
| 9,163,447 | B1 | 10/2015 | Liang et al. | |
| 9,328,544 | B1 | 5/2016 | Liang et al. | |
| 9,874,049 | B1 * | 1/2018 | McGregor | E05F 3/20 |
| 2011/0291538 | A1 * | 12/2011 | Brunnmayr | E05F 5/006 312/326 |
| 2012/0126677 | A1 * | 5/2012 | Ahlfeld | E05F 5/006 312/326 |
| 2012/0174338 | A1 * | 7/2012 | Wu | E05F 5/006 16/297 |
| 2013/0145580 | A1 * | 6/2013 | Brunnmayr | E05F 5/006 16/277 |
| 2013/0160242 | A1 * | 6/2013 | Brunnmayr | E05F 5/006 16/286 |
| 2013/0167323 | A1 * | 7/2013 | Brunnmayr | E05D 11/1014 16/50 |
| 2014/0345081 | A1 * | 11/2014 | Salice | E05F 5/006 16/50 |
| 2016/0032636 | A1 * | 2/2016 | Dai | E05F 5/006 16/65 |
| 2016/0138319 | A1 * | 5/2016 | Wu | E05D 3/02 16/50 |

* cited by examiner

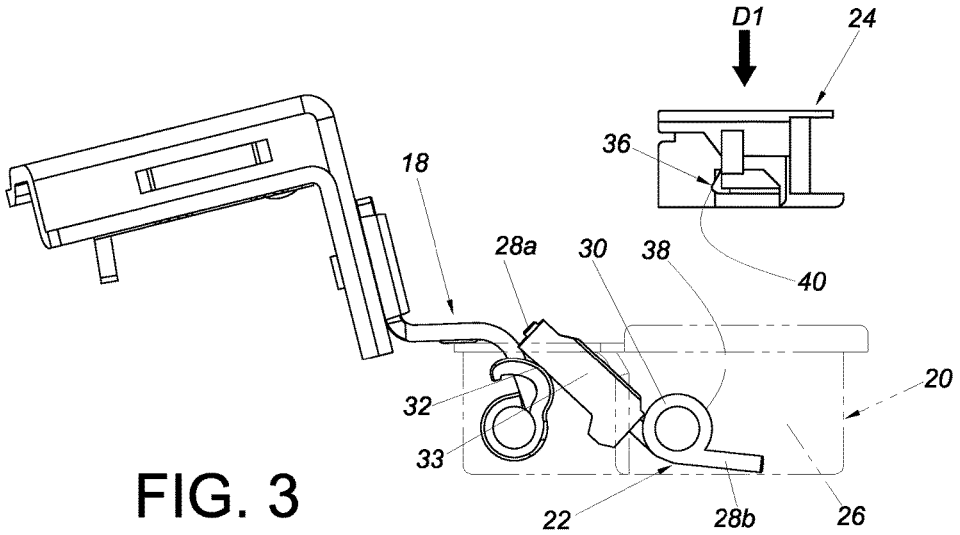
FIG. 3
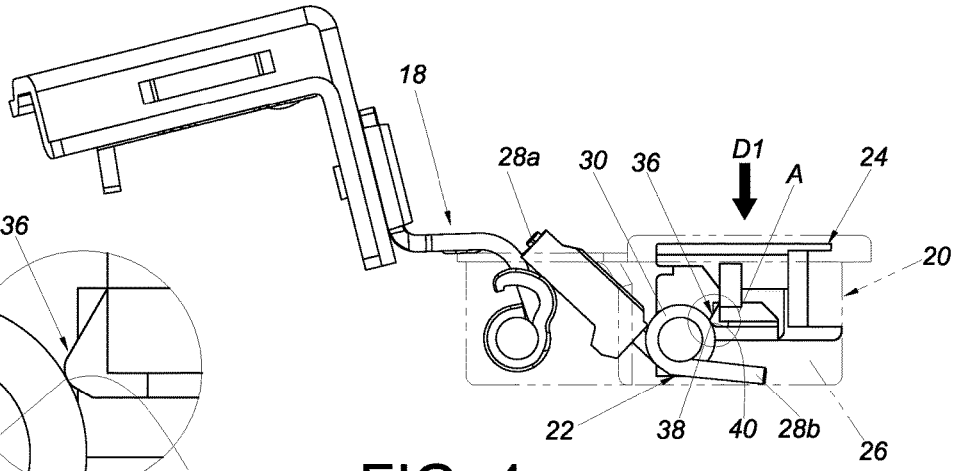
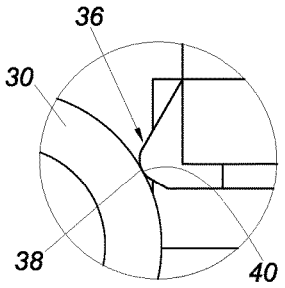
FIG. 5
FIG. 4
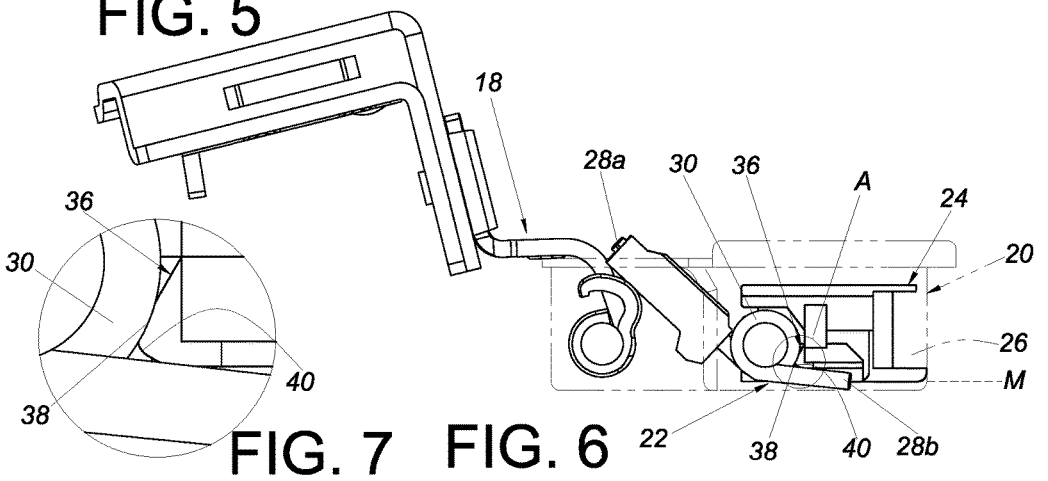
FIG. 7 FIG. 6

HINGE

FIELD OF THE INVENTION

The present invention relates to a hinge and more particularly to one whose hinge cup is configured to be mounted with a retaining member.

BACKGROUND OF THE INVENTION

Generally, a furniture cabinet is mounted with hinges so that a door panel can be opened and closed with respect to a fixed portion of the cabinet. As hinge-related technology advances, functional components are added to hinges and are usually mounted in the hinge cups. The interior of a hinge cup, therefore, may need a shielding member for protection.

SUMMARY OF THE INVENTION

The present invention relates to a hinge whose hinge cup is configured to be mounted with a retaining member.

According to one aspect of the present invention, a hinge includes a hinge arm, a hinge cup, at least one resilient member, and a retaining member. The hinge cup is pivotally connected with respect to the hinge arm and includes a receiving room. The resilient member is mounted in the receiving room of the hinge cup. The retaining member is engaged with the resilient member through an engaging feature.

Preferably, the resilient member and the engaging feature include a first guiding section and a second guiding section respectively, wherein the first guiding section and the second guiding section work with each other to facilitate engagement of the retaining member with the resilient member.

Preferably, each of the first guiding section and the second guiding section is a curved or inclined surface.

Preferably, the engaging feature is integrally formed with the retaining member, and the retaining member is made of plastic.

Preferably, the resilient member provides a resilient closing force when the hinge cup is pivoted, and thereby closed, with respect to the hinge arm.

Preferably, the retaining member includes a channel, and the hinge further includes a damper mounted in the channel of the retaining member and corresponding to the hinge arm.

Preferably, the damper includes a piston rod, and the hinge further includes an adjusting member movably mounted at the retaining member. The adjusting member includes a surface, a first contact portion, and a second contact portion. The first contact portion is spaced from the surface by a first distance, and the second contact portion is spaced from the surface by a second distance, wherein the first distance is greater than the second distance. When the adjusting member is at a first position with respect to the retaining member, the first contact portion of the adjusting member corresponds to the piston rod of the damper, so when the hinge cup is being closed with respect to the hinge arm under this condition and thereby drives the hinge arm to push and displace the damper, the piston rod of the damper will be pressed against the first contact portion of the adjusting member to produce a first damping effect. When the adjusting member is at a second position with respect to the retaining member, the second contact portion of the adjusting member corresponds to the piston rod of the damper, so when the hinge cup is being closed with respect to the hinge arm under this condition and thereby drives the hinge arm to push and displace the damper, the piston rod of the damper will be pressed against the second contact portion of the adjusting member to produce a second damping effect.

Preferably, the adjusting member further includes a third contact portion. The third contact portion is spaced from the surface by a third distance, and the second distance between the second contact portion and the surface is greater than the third distance. When the adjusting member is at a third position with respect to the retaining member, the third contact portion of the adjusting member corresponds to the piston rod of the damper, so when the hinge cup is being closed with respect to the hinge arm under this condition and thereby drives the hinge arm to push and displace the damper, the piston rod of the damper will be pressed against the third contact portion of the adjusting member to produce a third damping effect.

Preferably, the adjusting member includes an engaging portion, and the retaining member includes an upper portion whose periphery has a first engagement portion and a second engagement portion. When the adjusting member is operated and thus displaced to the first position with respect to the retaining member, the engaging portion of the adjusting member is pressed against the first engagement portion of the retaining member. When the adjusting member is operated and thus displaced to the second position with respect to the retaining member, the engaging portion of the adjusting member is pressed against the second engagement portion of the retaining member.

Preferably, the periphery of the upper portion of the retaining member includes a third engagement portion in addition to the first engagement portion and the second engagement portion. When the adjusting member is operated and thus displaced to the third position with respect to the retaining member, the engaging portion of the adjusting member is pressed against the third engagement portion of the retaining member.

Preferably, the retaining member has a lower portion opposite the upper portion and a main body portion connected between the upper portion and the lower portion of the retaining member. The lower portion has a periphery with a lip section. The adjusting member is movably mounted between the upper portion of the retaining member and the lip section of the lower portion of the retaining member.

Preferably, the upper portion of the retaining member includes a first mark, a second mark, and a third mark, and the adjusting member further includes a pointed portion. When the adjusting member is at the first position with respect to the retaining member, the pointed portion corresponds to the first mark. When the adjusting member is at the second position with respect to the retaining member, the pointed portion corresponds to the second mark. When the adjusting member is at the third position with respect to the retaining member, the pointed portion corresponds to the third mark.

Preferably, the hinge is applicable to a cabinet that includes a first component and a second component, wherein the second component can be opened and closed with respect to the first component. The hinge includes a hinge mounting member in addition to the hinge arm, the hinge cup, the at least one resilient member, and the retaining member. The hinge mounting member is mountable at the first component. The hinge arm is connected between the hinge mounting member and the hinge cup. The hinge cup is mountable at the second component of the cabinet.

Preferably, the retaining member is mounted at the resilient member and shields at least a portion of the receiving room of the hinge cup.

BRIEF DESCRIPTION OF THE DRAWINGS

FIG. 3 shows that the retaining member in the first embodiment of the present invention is moved in a certain direction in order to be mounted in the hinge cup;

FIG. 4 shows that the retaining member in the first embodiment of the present invention is brought into contact with the resilient members while being mounted into the hinge cup;

FIG. 5 is an enlarged view of the circled area A in FIG. 4;

FIG. 6 shows that the retaining member in the first embodiment of the present invention is mounted in the hinge cup;

FIG. 7 is an enlarged view of the circled area A in FIG. 6;

DETAILED DESCRIPTION OF THE INVENTION

Figure 1:
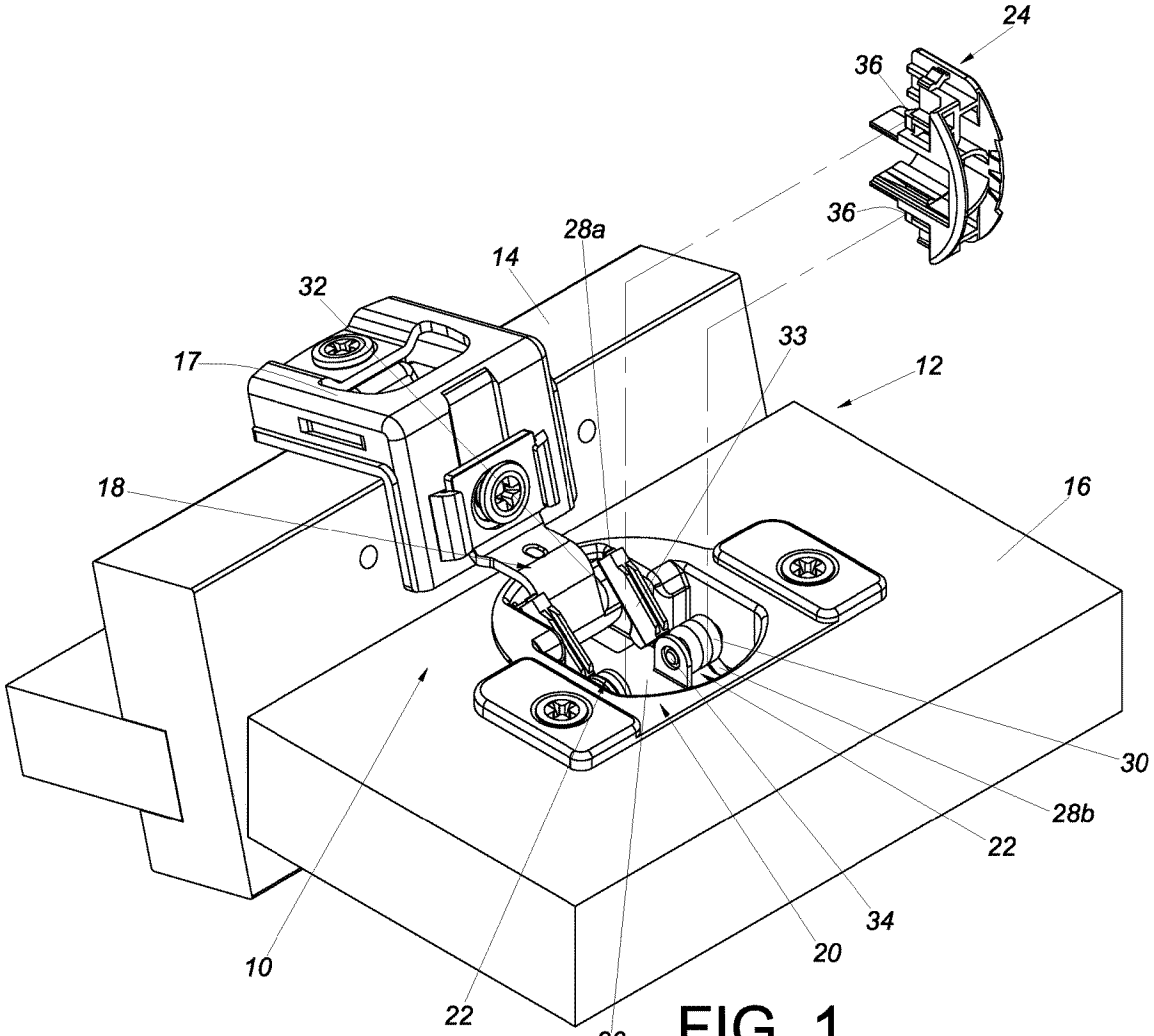
FIG. 1 is a perspective view of the hinge in accordance with the first embodiment of the present invention, showing the hinge applied to a cabinet, with the retaining member separated from the hinge cup.
Figure 2:
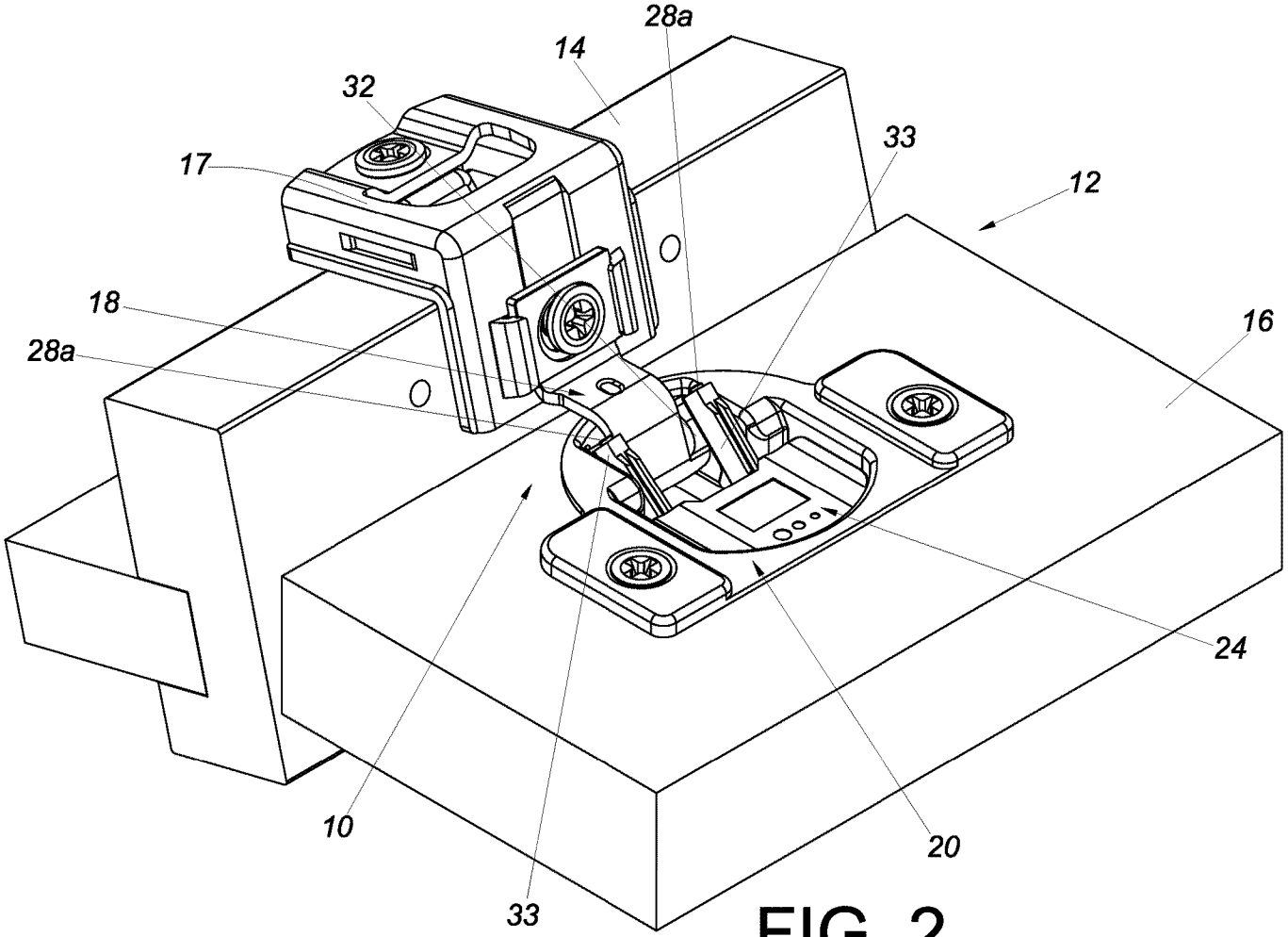
FIG. 2 is another perspective view of the hinge in accordance with the first embodiment of the present invention, showing the retaining member is mounted in the hinge cup.

As shown in FIG. 1 and FIG. 2, the hinge 10 in the first embodiment of the present invention can be applied to a cabinet 12 (e.g., a furniture cabinet or the like). The cabinet 12 includes a first component 14 and a second component 16, wherein the second component 16 can be opened and closed with respect to the first component 14. The hinge 10 includes a hinge mounting member 17, a hinge aim 18, a hinge cup 20, at least one resilient member 22, and a retaining member 24. The hinge aim 18 is connected between the hinge mounting member 17 and the hinge cup 20.

The hinge mounting member 17 is configured to be mounted to the first component 14.

The hinge cup 20 is configured to be mounted to the second component 16 and is pivotally connected with respect to the hinge arm 18. The hinge cup 20 includes a receiving room 26. When the second component 16 is opened (or closed) with respect to the first component 14, the hinge cup 20 is opened (or closed) with respect to the hinge aim 18.

The at least one resilient member 22 is mounted in the receiving room 26 of the hinge cup 20. Here, two resilient members 22 are provided by way of example, wherein each resilient member 22 is a torsion spring and can provide a resilient force for closing, or a resilient closing force, while the hinge cup 20 is pivoted from an opened state to a closed state with respect to the hinge arm 18. More specifically, each resilient member 22 includes a first leg 28*a*, a second leg 28*b*, and a coil portion 30 connected between the first leg 28*a* and the second leg 28*b*. The first leg 28*a* is pressed against the hinge arm 18, such as against a cam portion 32 of the hinge arm 18. Preferably, the first leg 28*a* is pressed against the cam portion 32 of the hinge arm 18 through a protective cover 33. The second leg 28*b*, on the other hand, is pressed against a wall portion of the receiving room 26 of the hinge cup 20. Here, each resilient member 22 is mounted to the hinge cup 20 via a pin 34 that extends through the corresponding coil portion 30.

The retaining member 24 is configured to be mounted to the at least one resilient member 22. Preferably, the retaining member 24 can engage with the at least one resilient member 22 through at least one engaging feature 36. Here, two engaging features 36 are provided by way of example, wherein each engaging feature 36 is configured to engage with the coil portion 30 of the corresponding resilient member 22. Preferably, the engaging features 36 are integrally formed with the retaining member 24, and the engaging features 36 and the retaining member 24 may be made of plastic or metal. Here, the engaging features 36 and the retaining member 24 are made of plastic by way of example, but the present invention has no limitation in this regard. Furthermore, each engaging feature 36 is a projection by way of example. The retaining member 24 is configured to shield at least a portion of the receiving room 26 of the hinge cup 20 so that dust and dirt are kept from entering the receiving room 26 of the hinge cup 20.

As shown in FIG. 3, the hinge cup 20 can be brought into an opened state with respect to the hinge arm 18, and the at least one resilient member 22 includes a first guiding section 38, which is a curved surface by way of example here. Preferably, the coil portion 30 of each resilient member 22 has an outer contour forming that curved surface. In addition, each engaging feature 36 of the retaining member 24 includes a second guiding section 40. Here, each second guiding section 40 is one of a curved surface and an inclined surface by way of example.

Referring to FIG. 4 to FIG. 7, while the hinge cup 20 is in the opened state with respect to the hinge arm 18, a user can displace the retaining member 24 in a first direction D1 from outside the receiving room 26 of the hinge cup 20 toward the inside of the receiving room 26 of the hinge cup 20 so that the retaining member 24 is engaged with the at least one resilient member 22. More specifically, in the course in which the retaining member 24 is displaced in the first direction D1, the second guiding sections 40 of the engaging features 36 work with the first guiding sections 38 of the resilient members 22 respectively to facilitate engagement of the retaining member 24 with the resilient members 22. For example, in the course in which the retaining member 24 is displaced in the first direction D1, the second guiding sections 40 of the engaging features 36 are brought into contact with the first guiding sections 38 of the resilient members 22 respectively, and upon reaching a mounting position M, the retaining member 24 engages with the coil portions 30 of the resilient members 22 via the engaging features 36 respectively. In other words, each engaging feature 36 is pressed tightly against a lateral side of the coil portion 30 of the corresponding resilient member 22 when the retaining member 24 is at the mounting position M.

Figure 8:
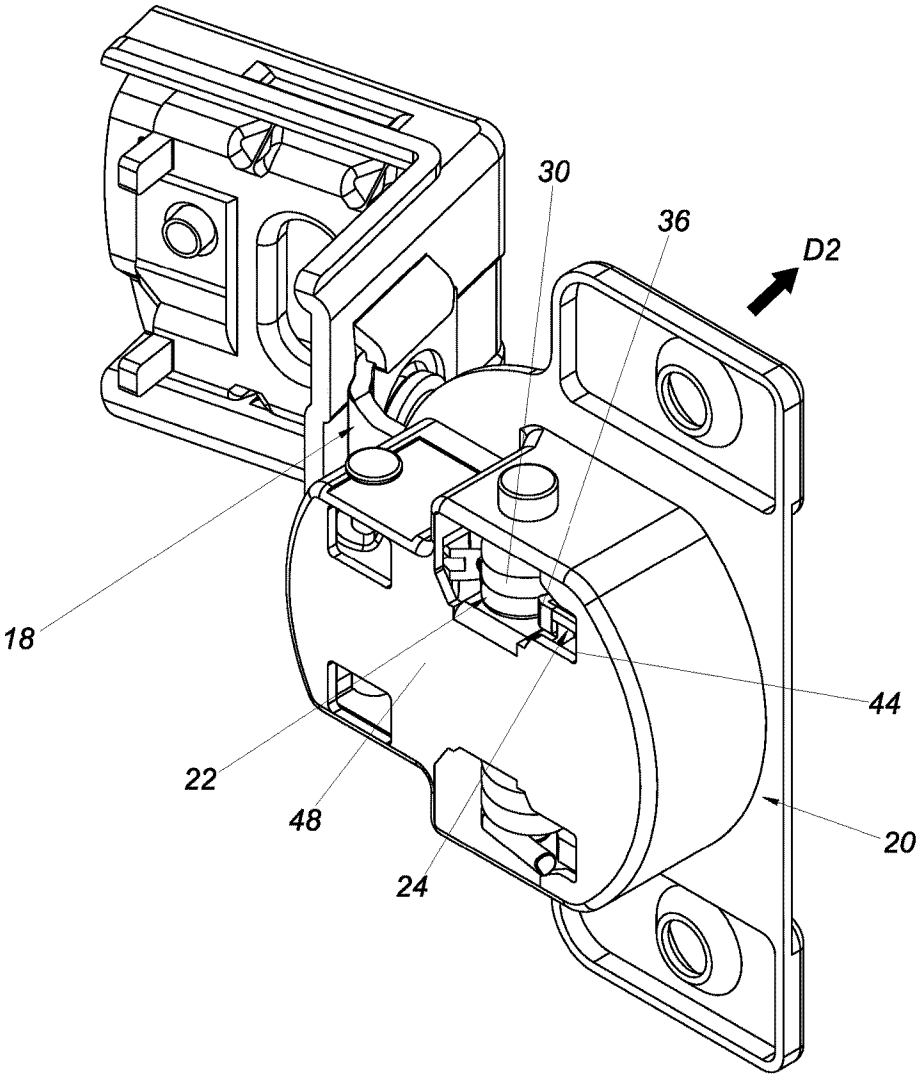
FIG. 8 shows that a force in another direction can be applied to the retaining member in the first embodiment of the present invention.

Referring to FIG. 8, while the hinge cup 20 is in the opened state with respect to the hinge arm 18, a user can apply a force in a second direction D2 (which is the opposite direction of the first direction D1) to disengage the retaining member 24 from the coil portions 30 of the resilient members 22. For example, a user can remove the retaining member 24 from the mounting position M by applying a force in the second direction D2. In one preferred embodiment in which the hinge cup 20 has a bottom wall 48 formed with an aperture 44 in communication with the receiving room 26 of the hinge cup 20, a user can apply a force in the second direction D2 to the retaining member 24 through the aperture 44 in order to bring the engaging features 36 of the retaining member 24 out of engagement with the coil portions 30 of the resilient members 22, i.e., to move the retaining member 24 away from the mounting position M (as shown in FIG. 6, FIG. 4, and FIG. 3 sequentially).

Figure 9:
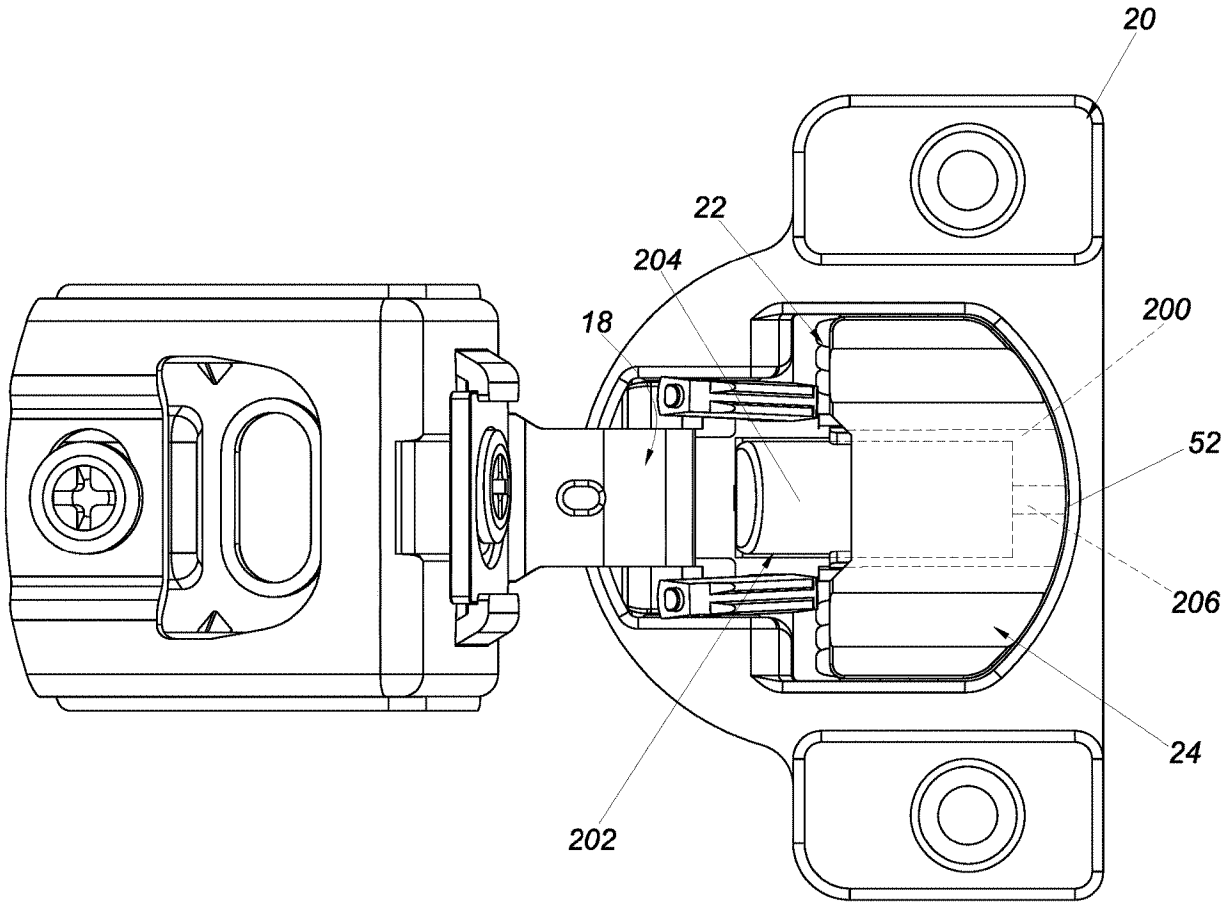
FIG. 9 shows the hinge in accordance with the second embodiment of the present invention.

FIG. 9 shows the hinge in the second embodiment of the present invention. The second embodiment is different from the first embodiment substantially in that the retaining member 24 includes a channel 200, that the hinge further includes a damper 202 movably mounted in the channel 200 of the retaining member 24, and that the damper 202 corresponds in position to the hinge arm 18. More specifically, the damper 202 includes a cylinder 204 and a piston rod 206. The cylinder 204 contains a damping medium. (As the structure of such a cylinder is readily understandable to a person of ordinary skill in the art, a more detailed description is omitted herein.) The piston rod 206 extends out of the cylinder 204. The piston rod 206 in this embodiment extends toward a wall portion (e.g., a rear wall 52) of the hinge cup 20.

The damper 202 is configured to provide a damping effect. For example, while the hinge cup 20 is being pivoted from an opened state to a closed state with respect to the hinge arm 18, each resilient member 22 provides a resilient closing force, and the cylinder 204 of the damper 202 is pushed by the hinge arm 18 such that the piston rod 206 of the damper 202 is pressed against the rear wall 52 of the hinge cup 20 and then retracted with respect to the cylinder 204 to produce a damping effect. When the hinge is applied to the foregoing cabinet 12, therefore, a certain stage (e.g., the very last stage) of the process of closing the second component 16 with respect to the first component 14 is damped.

Figure 10:
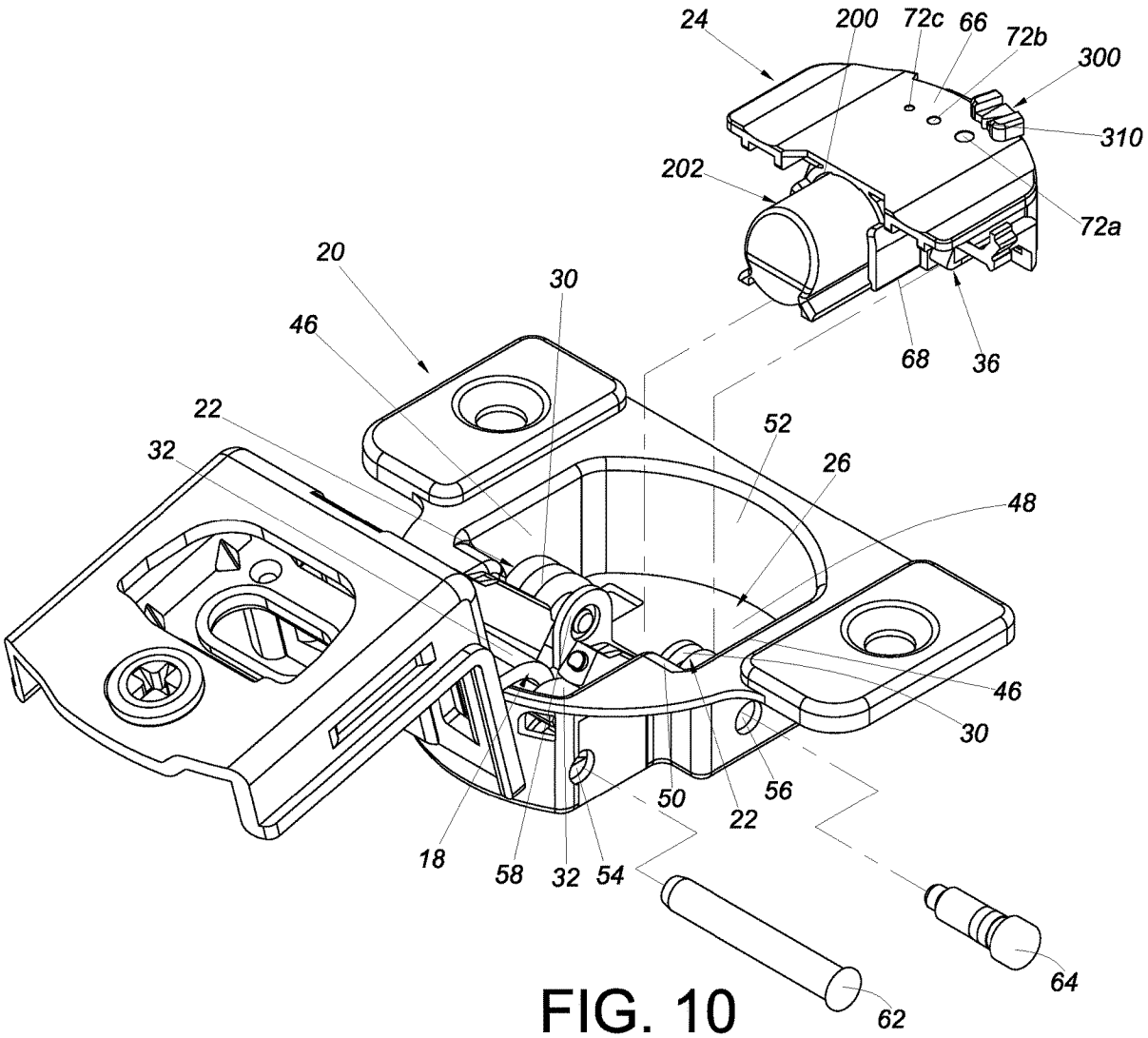
FIG. 10 is an exploded view of the hinge in accordance with the third embodiment of the present invention.

FIG. 10 shows the hinge in the third embodiment of the present invention. The third embodiment is different from the second embodiment substantially in that the hinge further includes an adjusting member 300 movably mounted at the retaining member 24.

As stated above, the retaining member 24 is engaged with the coil portions 30 of the resilient members 22 through the engaging features 36 respectively, and the damper 202 is movably mounted in the channel 200 of the retaining member 24.

The hinge cup 20 includes a pair of sidewalls 46 and a front wall 50 in addition to the bottom wall 48 and the rear wall 52. Preferably, each of the sidewalls 46 has a first connecting hole 54 and a second connecting hole 56, wherein the two first connecting holes 54 correspond in position to each other, and the two second connecting holes 56 correspond in position to each other. (Please note that FIG. 10 shows only one first connecting hole 54 and only one second connecting hole 56 due to limitation of the viewing angle.) The bottom wall 48 extends between the sidewalls 46. The front wall 50 extends between the front ends of the sidewalls 46. The rear wall 52 extends between the rear ends of the sidewalls 46. The sidewalls 46, the bottom wall 48, the front wall 50, and the rear wall 52 jointly define the receiving room 26. The bottom wall 48 of the receiving room 26 includes a pair of lugs 58 (only one of which is shown in FIG. 10 due to limitation of the viewing angle), wherein each lug 58 corresponds to the second connecting hole 56 in the corresponding sidewall 46. As previously mentioned, the hinge cup 20 is pivotally connected with respect to the hinge arm 18 and is, for example, pivotally connected to the hinge arm 18 by a shaft 62 that extends through the first connecting holes 54.

Each resilient member 22 is mounted between the corresponding sidewall 46 of the hinge cup 20 and the corresponding lug 58. The resilient members 22 are positioned in the receiving room 26 thanks to a pin 64 that passes through the second connecting holes 56 in the sidewalls 46, the coil portions 30 of the resilient members 22, and the lugs 58.

Figure 11:
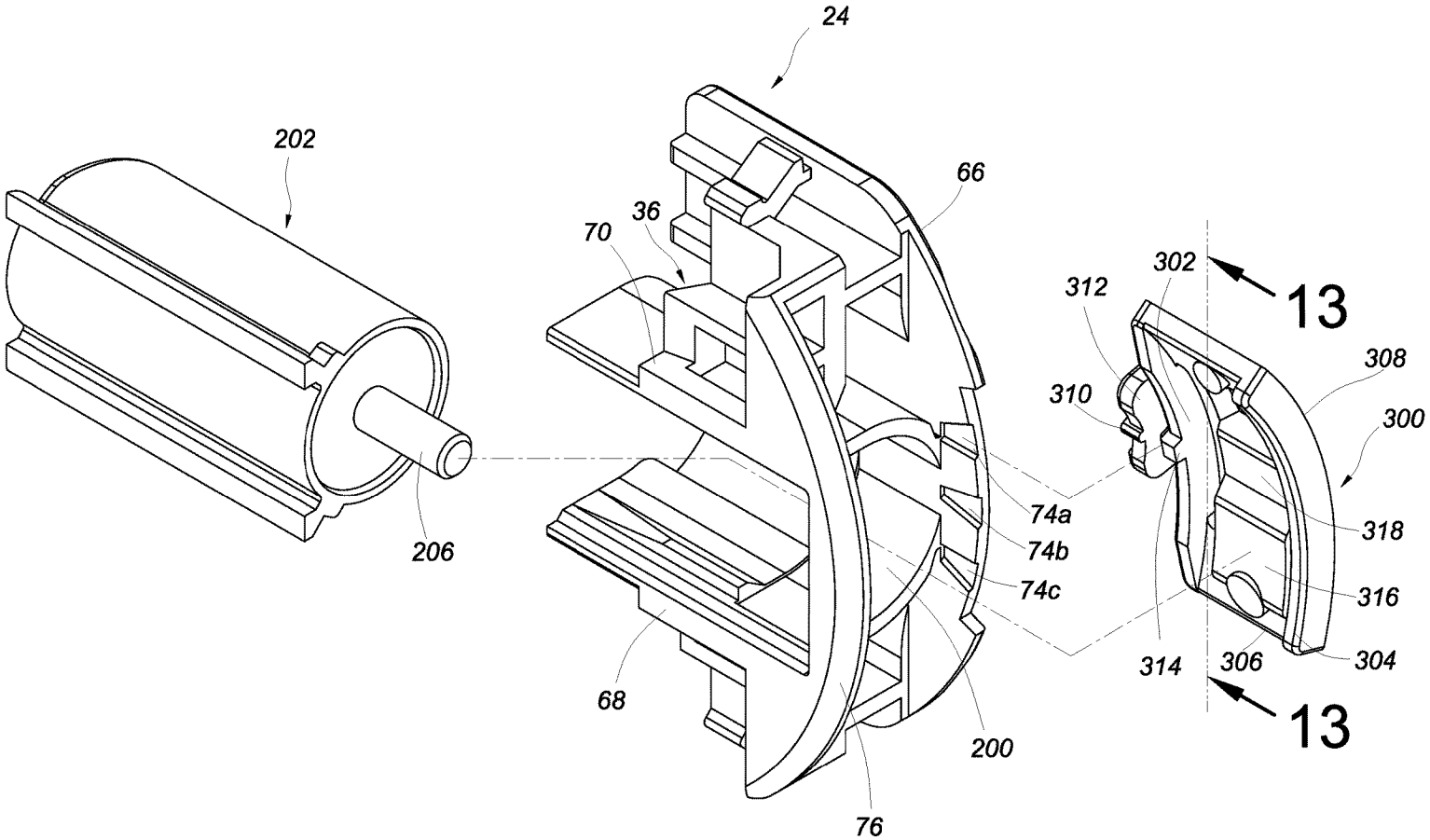
FIG. 11 is an exploded view of the retaining member, the damper, and the adjusting member of the hinge in accordance with the third embodiment of the present invention.

Preferably, referring to FIG. 10 and FIG. 11, the retaining member 24 includes an upper portion 66, a lower portion 68 opposite the upper portion 66, and a main body portion 70 connected between the upper portion 66 and the lower portion 68. The upper portion 66 has a first mark 72*a*, a second mark 72*b*, and a third mark 72*c* on its surface (see FIG. 10). The upper portion 66 further has a first engagement portion 74*a*, a second engagement portion 74*b*, and a third engagement portion 74*c* along a portion of its periphery that faces the rear wall 52 of the hinge cup 20 (see FIG. 11). Preferably, the first mark 72*a*, the second mark 72*b*, and the third mark 72*c* are word-, number-, or pattern-based feature marks, by which a user can identify the angular ranges of the closing stage in which the damper 202 produces a predetermined damping effect. In addition, the periphery of the lower portion 68 has a lip section 76, and the main body portion 70 has the channel 200.

The damper 202 is movably mounted in the channel 200 of the retaining member 24. While the hinge cup 20 is being closed with respect to the hinge arm 18, the hinge arm 18 pushes and thereby displaces the damper 202 mounted in the channel 200 of the retaining member 24.

Figure 12:
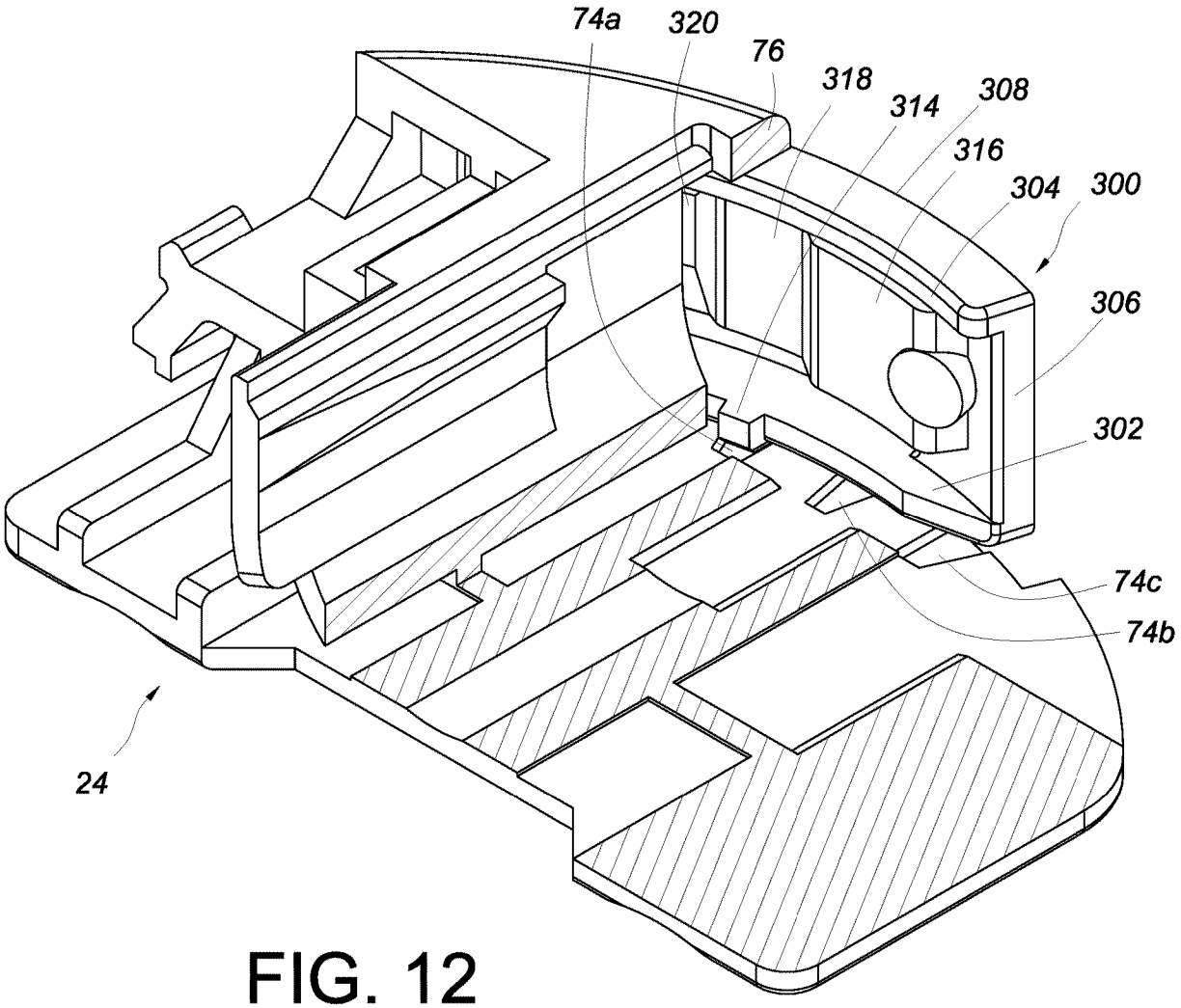
FIG. 12 is an assembled cutaway view of the retaining member and the adjusting member of the hinge in accordance the third embodiment of the present invention.

Referring to FIG. 10, FIG. 11, and FIG. 12, the adjusting member 300 is located between the upper portion 66 and the lower portion 68 (or the lip section 76) of the retaining member 24. The adjusting member 300 includes an upper supporting frame 302, a lower supporting frame 304, and a side plate 306. The lower supporting frame 304 is located opposite the upper supporting frame 302. The side plate 306 is connected between the upper supporting frame 302 and the lower supporting frame 304 and has a surface 308. The adjusting member 300 is movably engaged with the retaining member 24 through one of the upper supporting frame 302 and the lower supporting frame 304.

Moreover, the upper supporting frame 302 of the adjusting member 300 includes a pointed portion 310, an operating portion 312, and an engaging portion 314. When the adjusting member 300 is adjusted, and thereby displaced, with respect to the retaining member 24, the engaging portion 314 is selectively moved to, and hence lightly engaged with, the first engagement portion 74*a*, the second engagement portion 74*b*, or the third engagement portion 74*c* of the retaining member 24, with the pointed portion 310 pointing to a corresponding one of the first mark 72*a*, the second mark 72*b*, and the third mark 72*c* on the retaining member 24 in order for the user to identify the position the adjusting member 300 is adjusted to. The operating portion 312 makes it easier for the user to push the adjusting member 300 and thereby displace the adjusting member 300 with respect to the retaining member 24.

Figure 13:
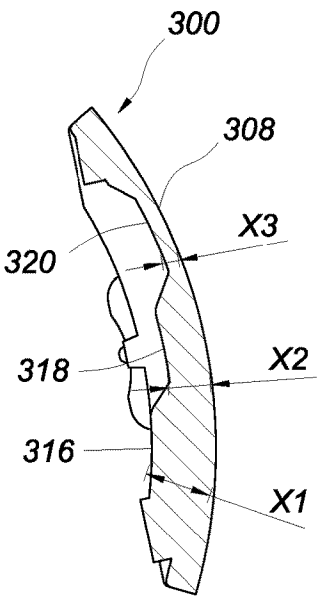
FIG. 13 is a sectional view taken along line 13-13 in FIG. 11, showing in particular the first contact portion, the second contact portion, and the third contact portion of the adjusting member.

Referring to FIG. 12 and FIG. 13, the side plate 306 of the adjusting member 300 has a first contact portion 316, a second contact portion 318, and a third contact portion 320. The first contact portion 316, the second contact portion 318, and the third contact portion 320 are spaced from the surface 308 of the side plate 306 by a first distance X1, a second distance X2, and a third distance X3 respectively. The first distance X1 is greater than the second distance X2, and the second distance X2 is greater than the third distance X3.

Figure 14:
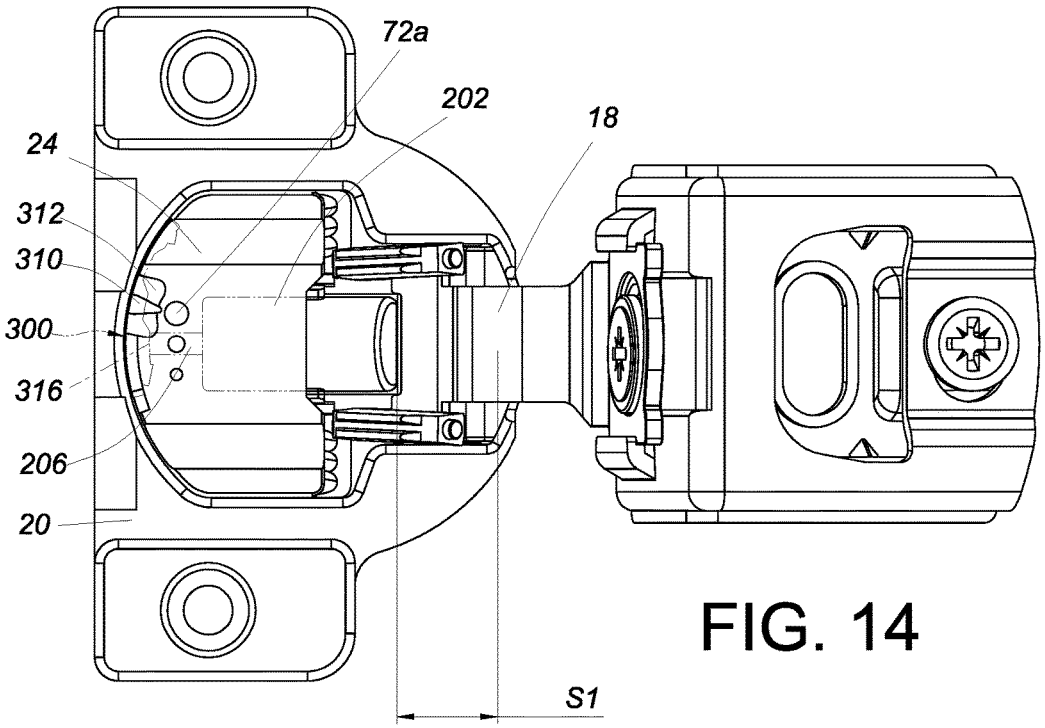
FIG. 14 shows that the adjusting member in the third embodiment of the present invention is adjusted to a first position where a first empty section is formed between the damper and the hinge arm.

Referring to FIG. 14 in conjunction with FIG. 11, when the adjusting member 300 is operated via the operating portion 312 and reaches a first position with respect to the retaining member 24, the engaging portion 314 is engaged with the first engagement portion 74*a* (see FIG. 12), the pointed portion 310 of the adjusting member 300 points to the first mark 72*a*, and the piston rod 206 of the damper 202 corresponds to the first contact portion 316. In this state, a first empty section S1 is formed between the damper 202 and the hinge arm 18.

Figure 15:
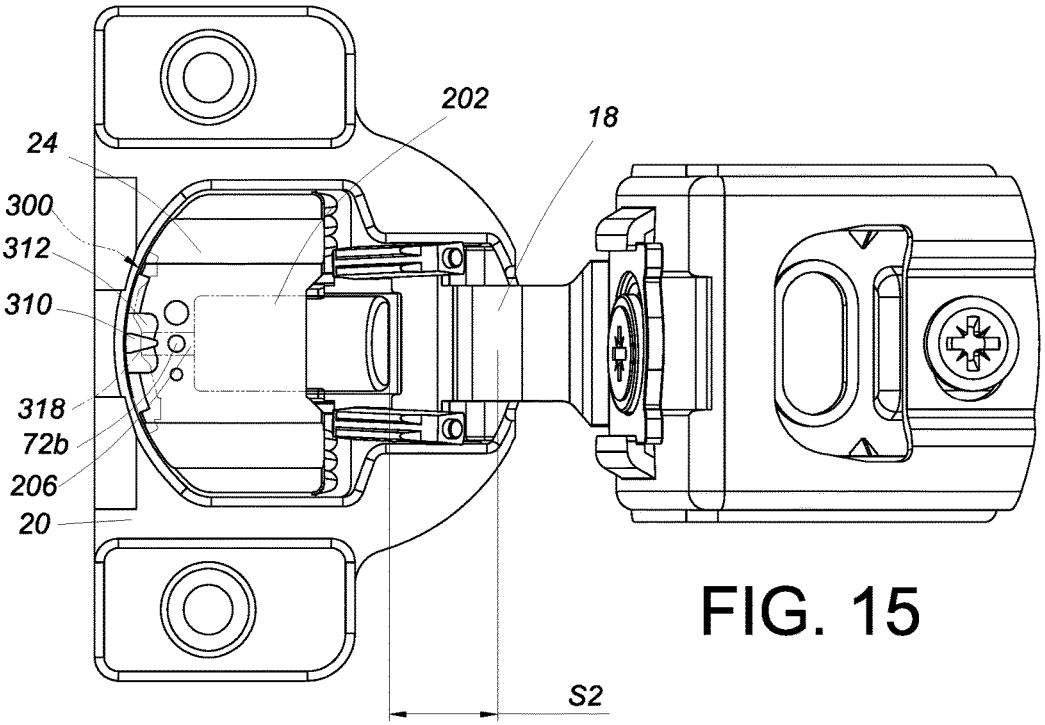
FIG. 15 shows that the adjusting member in the third embodiment of the present invention is adjusted to a second position where a second empty section is formed between the damper and the hinge arm.

Referring to FIG. 15 in conjunction with FIG. 11, when the adjusting member 300 is operated via the operating portion 312 and reaches a second position with respect to the retaining member 24, the engaging portion 314 is engaged with the second engagement portion 74*b*, the pointed portion 310 of the adjusting member 300 points to the second mark 72*b*, and the piston rod 206 of the damper 202 corresponds to the second contact portion 318. In this state, a second empty section S2 is formed between the damper 202 and the hinge arm 18.

Figure 16:
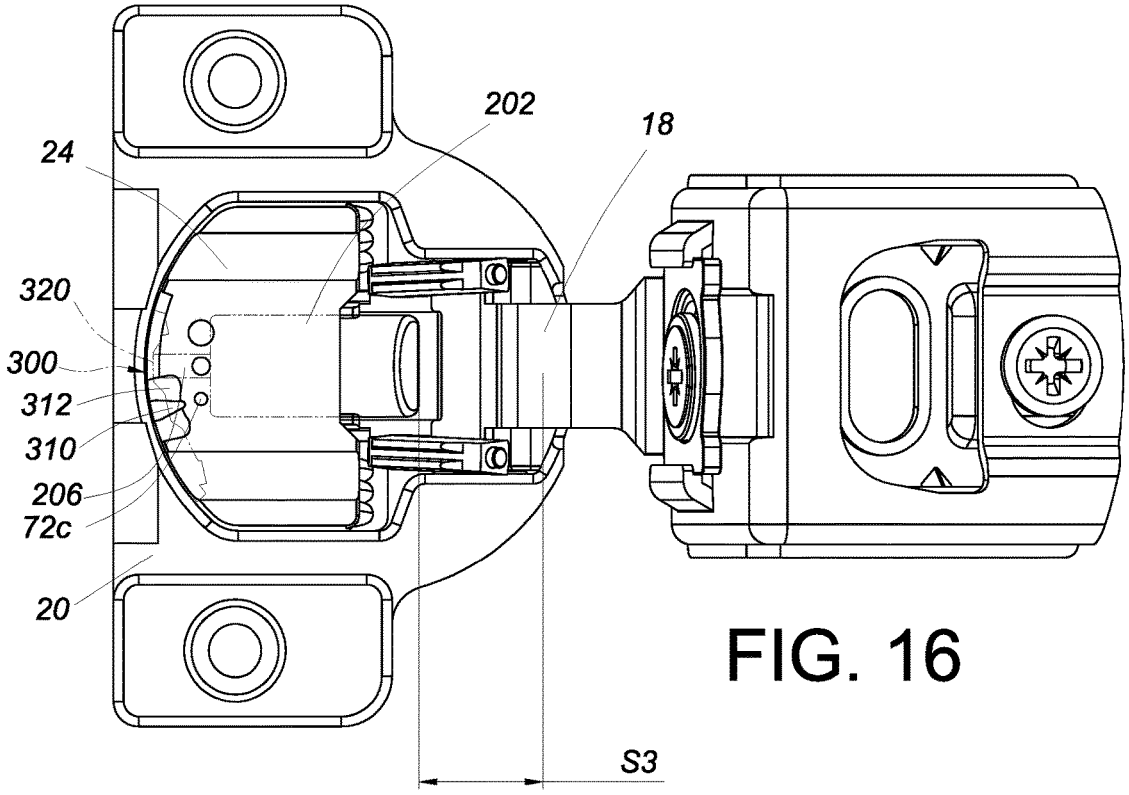
FIG. 16 shows that the adjusting member in the third embodiment of the present invention is adjusted to a third position where a third empty section is formed between the damper and the hinge arm.

Referring to FIG. 16 in conjunction with FIG. 11, when the adjusting member 300 is operated via the operating portion 312 and reaches a third position with respect to the retaining member 24, the engaging portion 314 is engaged with the third engagement portion 74*c*, the pointed portion 310 of the adjusting member 300 points to the third mark 72*c*, and the piston rod 206 of the damper 202 corresponds to the third contact portion 320. In this state, a third empty section S3 is formed between the damper 202 and the hinge arm 18.

Figure 18:
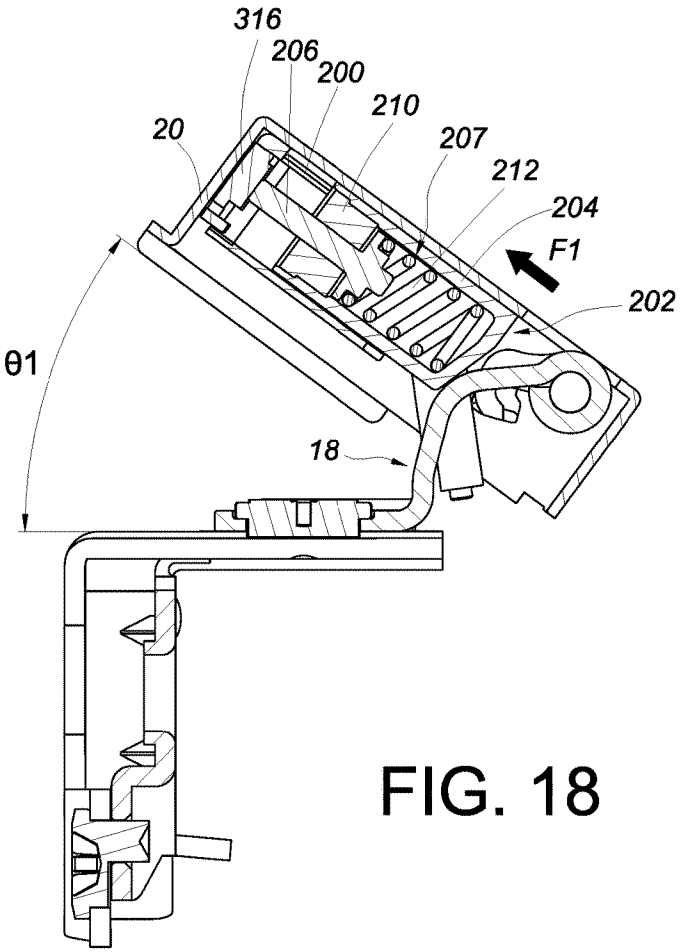
FIG. 18 shows that the hinge cup in the third embodiment of the present invention is being closed and has been moved from the opened state to a state in which the hinge cup is at a first predetermined angle with respect to the hinge arm.
Figure 17:
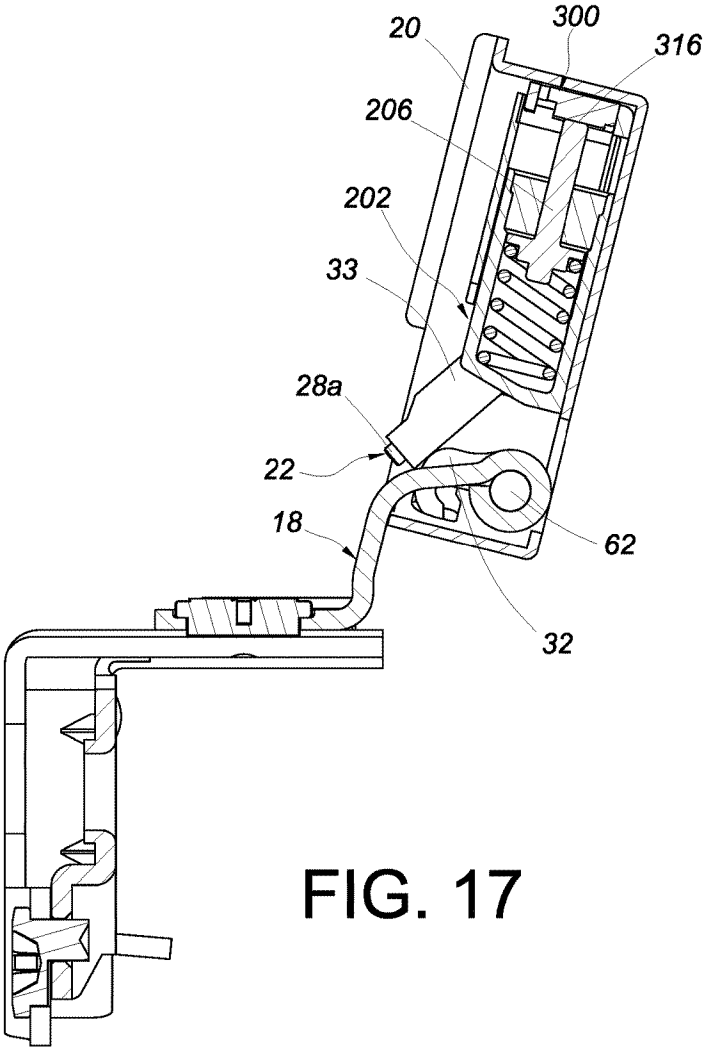
FIG. 17 shows that the hinge cup in the third embodiment of the present invention is in an opened state with respect to the hinge arm.
Figure 19:
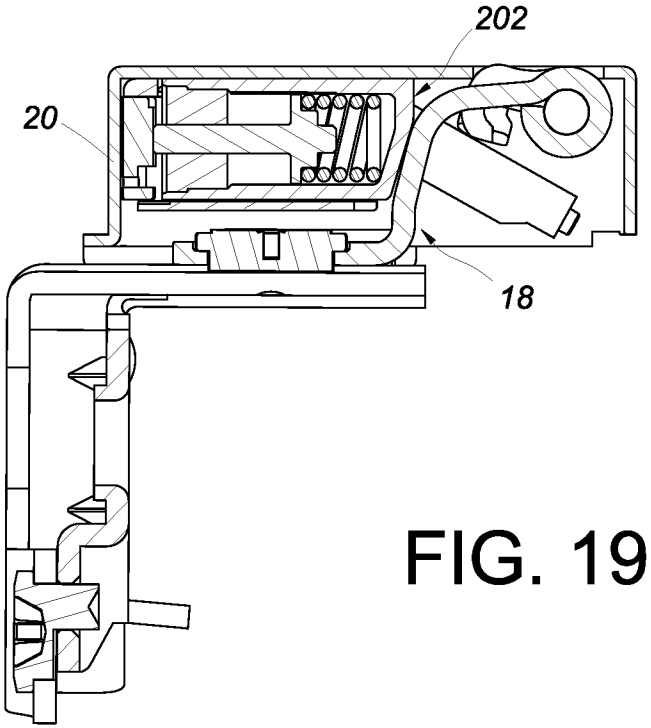
FIG. 19 shows that the hinge cup in the third embodiment of the present invention is brought into a closed state with respect to the hinge arm.

FIG. 17, FIG. 18, and FIG. 19 show how the damper 202 in the third embodiment of the present invention produces a first damping effect on the hinge.

When the adjusting member 300 is at the first position and the hinge cup 20 is in an opened state with respect to the hinge arm 18 as shown in FIG. 17, the hinge cup 20 (to which the hinge arm 18 is pivotally connected via the shaft 62) can be operated so as to pivot from the opened state to a closed state with respect to the hinge arm 18. In the last stage of the closing process, the resilient members 22 will provide a resilient closing force, with the first legs 28*a* of the resilient members 22 pressed respectively against the cam portions 32 of the hinge arms 18 through the protective covers 33, which serve to protect the first legs 28*a* of the resilient members 22 or the cam portions 32 of the hinge arms 18.

More specifically, when the hinge cup 20 being closed is about to enter the last stage of the closing process (as shown in FIG. 18), the hinge arm 18 pushes the damper 202 according to the first empty section S1 such that the piston rod 206 is pressed against the first contact portion 316 of the adjusting member 300. In fact, only when the hinge cup 20 is closed to a position where it is at a first predetermined angle θ1 with respect to the hinge arm 18 will the hinge arm 18 be able to push and thereby displace the cylinder 204 of the damper 202 along the channel 200 of the retaining member 24, in order for the piston rod 206 to retract with respect to the cylinder 204 and produce a first damping effect F1 through the damping medium 207 in the cylinder 204 of the damper 202 until the hinge cup 20 is in the closed state with respect to the hinge arm 18 (as shown in FIG. 19). The damping medium 207 may include a piston 210, an auxiliary resilient member 212, and preferably also a damping medium fluid. In practice, the damping medium of the damper 202 may be designed as needed and is not limited to that disclosed herein.

Figure 20:
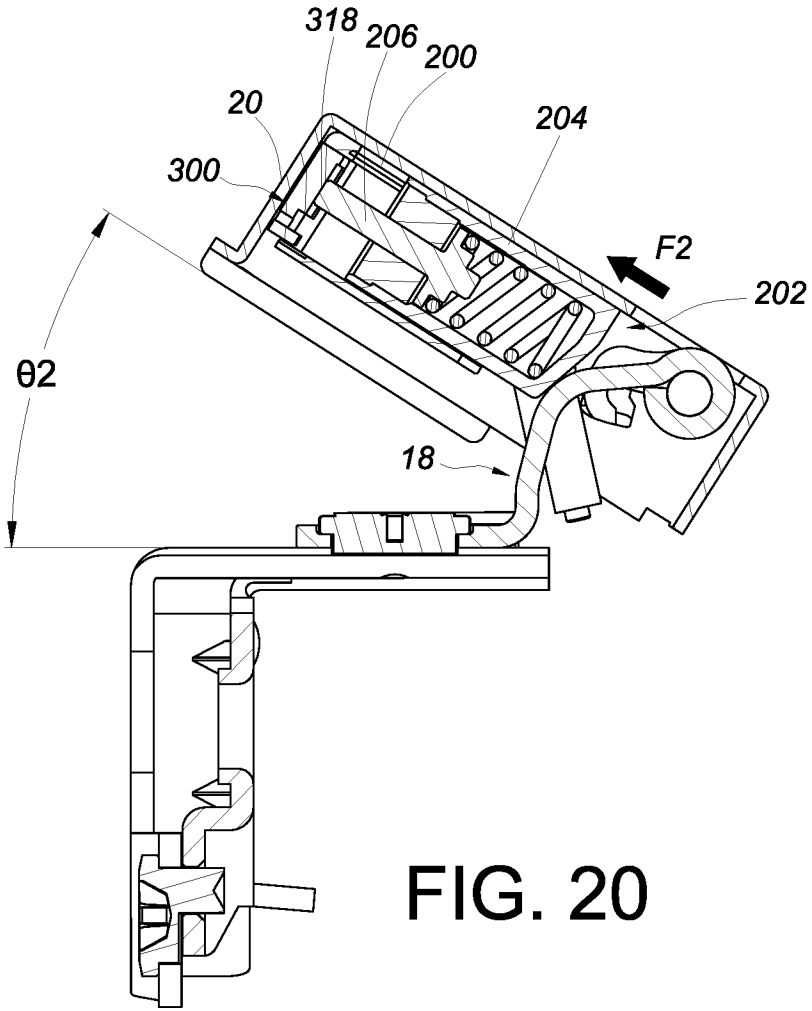
FIG. 20 shows that the hinge cup in the third embodiment of the present invention is being closed and has been moved from the opened state to a state in which the hinge cup is at a second predetermined angle with respect to the hinge arm.

FIG. 20 shows how the damper 202 in the third embodiment of the present invention produces a second damping effect on the hinge.

When the adjusting member 300 is at the second position and the hinge cup 20 is being closed with respect to the hinge arm 18 and is about to enter the last stage of the closing process, the hinge arm 18 pushes the damper 202 according to the second empty section S2 such that the piston rod 206 is pressed against the second contact portion 318 of the adjusting member 300. In fact, only when the hinge cup 20 is closed to a position where it is at a second predetermined angle θ2 with respect to the hinge arm 18 will the hinge arm 18 be able to push and thereby displace the cylinder 204 of the damper 202 along the channel 200 of the retaining member 24, in order for the piston rod 206 to retract with respect to the cylinder 204 and produce a second damping effect F2 until the hinge cup 20 is in the closed state with respect to the hinge arm 18.

Figure 21:
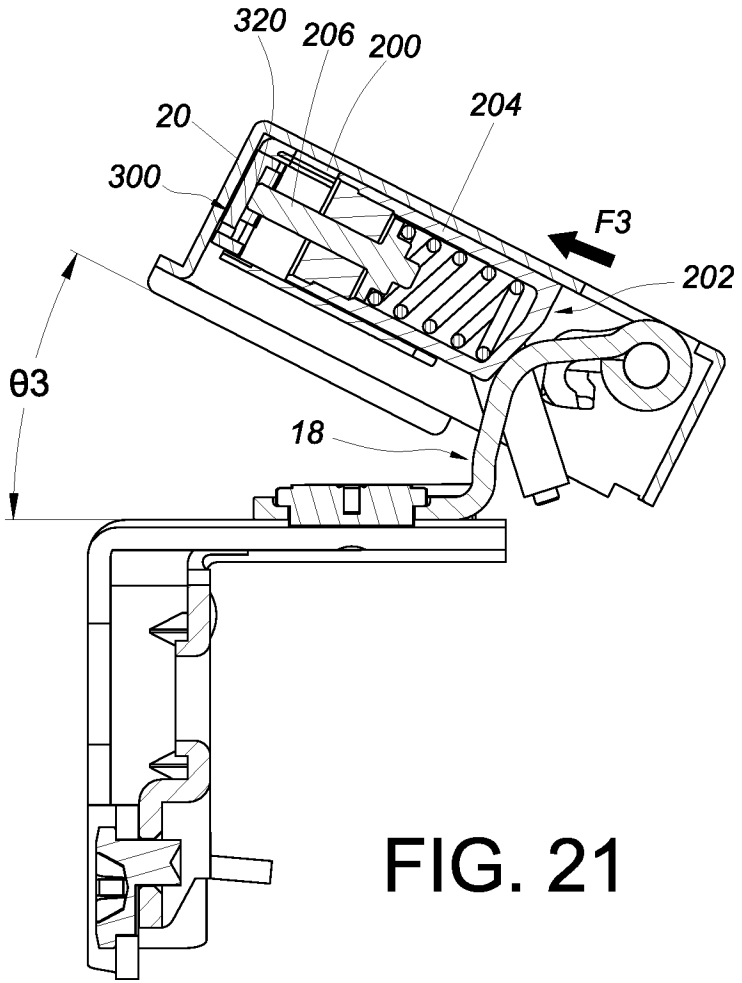
FIG. 21 shows that the hinge cup in the third embodiment of the present invention is being closed and has been moved from the opened state to a state in which the hinge cup is at a third predetermined angle with respect to the hinge aim.

FIG. 21 shows how the damper 202 in the third embodiment of the present invention produces a third damping effect on the hinge.

When the adjusting member 300 is at the third position and the hinge cup 20 is being closed with respect to the hinge arm 18 and is about to enter the last stage of the closing process, the hinge arm 18 pushes the damper 202 according to the third empty section S3 such that the piston rod 206 is pressed against the third contact portion 320 of the adjusting member 300. In fact, only when the hinge cup 20 is closed to a position where it is at a third predetermined angle θ3 with respect to the hinge arm 18 will the hinge arm 18 be able to push and thereby displace the cylinder 204 of the damper 202 along the channel 200 of the retaining member 24, in order for the piston rod 206 to retract with respect to the cylinder 204 and produce a third damping effect F3 until the hinge cup 20 is in the closed state with respect to the hinge arm 18.

As can be known from the above, the adjusting member 300 can be adjusted in position with respect to the retaining member 24 so that, when the hinge cup 20 is being closed with respect to the hinge arm 18 and is about to enter the last stage of the closing process, the hinge arm 18 can push the damper 202 in accordance with the adjustment in order for the damper 202 to produce the desired predetermined damping effect, thereby satisfying the damping need associated with closing the second component 16 of the cabinet 12 with respect to the first component 14 (e.g., to protect the components and eliminate noise).

The third embodiment of the present invention is so designed that the angular range of the closing stage in which the damper 202 produces a predetermined damping effect can be adjusted through the different contact portions of the adjusting member 300 to meet different damping needs respectively.

In summary, the hinge of the present invention preferably has the following features:

1. The retaining member 24, which is engaged with the at least one resilient member 22, can prevent dust and dirt from entering the receiving room 26 of the hinge cup 20.
2. The damper 202 is movably mounted in the channel 200 of the retaining member 24 to provide the hinge with a damping function, i.e., to produce a damping effect when the second component 16 (or the hinge cup 20) is being closed with respect to the first component 14 (or the hinge arm 18).
3. The angular range of the closing stage in which the damper 202 actually works can be adjusted through the adjusting member 300.

While the present invention has been disclosed through the preferred embodiments described above, it should be understood that the embodiments are not intended to be restrictive of the scope of the invention. The scope of patent protection sought by the applicant is defined by the appended claims.

What is claimed is:

1. A hinge, comprising:

a hinge arm;

a hinge cup pivotally connected with respect to the hinge arm and including a receiving room;

at least one resilient member mounted in the receiving room of the hinge cup;

a retaining member engaged with the resilient member through an engaging featured, the retaining member including a channel; and a damper mounted in the channel of the retaining member and corresponding to the hinge arm.

2. The hinge of claim 1, wherein the resilient member and the engaging feature include a first guiding section and a second guiding section respectively, and the first guiding section and the second guiding section work with each other to facilitate engagement of the retaining member with the resilient member.

3. The hinge of claim 2, wherein each of the first guiding section and the second guiding section is a curved or inclined surface.

4. The hinge of claim 2, wherein the engaging feature is integrally formed with the retaining member, and the retaining member is made of plastic.

5. The hinge of claim 1, wherein the resilient member provides a resilient closing force when the hinge cup is pivoted, and thereby closed, with respect to the hinge arm.

6. The hinge of claim 1, wherein the damper includes a piston rod; the hinge further comprises an adjusting member movably mounted at the retaining member; the adjusting member includes a surface, a first contact portion, and a second contact portion; the first contact portion is spaced from the surface by a first distance; the second contact portion is spaced from the surface by a second distance; and the first distance is greater than the second distance;

wherein when the adjusting member is at a first position with respect to the retaining member, the first contact portion of the adjusting member corresponds to the piston rod of the damper such that, when the hinge cup is being closed with respect to the hinge arm and thereby drives the hinge arm to push and displace the damper, the piston rod of the damper is pressed against the first contact portion of the adjusting member to produce a first damping effect; and wherein when the adjusting member is at a second position with respect to the retaining member, the second contact portion of the adjusting member corresponds to the piston rod of the damper such that, when the hinge cup is being closed with respect to the hinge arm and thereby drives the hinge arm to push and displace the damper, the piston rod of the damper is pressed against the second contact portion of the adjusting member to produce a second damping effect.

7. The hinge of claim 6, wherein the adjusting member further includes a third contact portion, the third contact portion is spaced from the surface by a third distance, and the second distance between the second contact portion and the surface is greater than the third distance; and wherein when the adjusting member is at a third position with respect to the retaining member, the third contact portion of the adjusting member corresponds to the piston rod of the damper such that, when the hinge cup is being closed with respect to the hinge arm and thereby drives the hinge arm to push and displace the damper, the piston rod of the damper is pressed against the third contact portion of the adjusting member to produce a third damping effect.

8. The hinge of claim 6, wherein the adjusting member includes an engaging portion; the retaining member includes an upper portion; the upper portion has a periphery with a first engagement portion and a second engagement portion; the engaging portion of the adjusting member is pressed against the first engagement portion of the retaining member when the adjusting member is operated and thus displaced to the first position with respect to the retaining member; and the engaging portion of the adjusting member is pressed against the second engagement portion of the retaining member when the adjusting member is operated and thus displaced to the second position with respect to the retaining member.

9. The hinge of claim 7, wherein the adjusting member includes an engaging portion; the retaining member includes an upper portion; the upper portion has a periphery with a first engagement portion, a second engagement portion, and a third engagement portion; the engaging portion of the adjusting member is pressed against the first engagement portion of the retaining member when the adjusting member is operated and thus displaced to the first position with respect to the retaining member; the engaging portion of the adjusting member is pressed against the second engagement portion of the retaining member when the adjusting member is operated and thus displaced to the second position with respect to the retaining member; and the engaging portion of the adjusting member is pressed against the third engagement portion of the retaining member when the adjusting member is operated and thus displaced to the third position with respect to the retaining member.

10. The hinge of claim 9, wherein the retaining member further includes a lower portion opposite the upper portion and a main body portion connected between the upper portion and the lower portion of the retaining member, the lower portion has a periphery with a lip section, and the adjusting member is movably mounted between the upper portion of the retaining member and the lip section of the lower portion of the retaining member.

11. The hinge of claim 10, wherein the upper portion of the retaining member includes a first mark, a second mark, and a third mark; the adjusting member includes a pointed portion; the pointed portion corresponds to the first mark when the adjusting member is at the first position with respect to the retaining member; the pointed portion corresponds to the second mark when the adjusting member is at the second position with respect to the retaining member; and the pointed portion corresponds to the third mark when the adjusting member is at the third position with respect to the retaining member.

12. A hinge applicable to a cabinet, wherein the cabinet includes a first component and a second component, and the second component is openable and closeable with respect to the first component, the hinge comprising:

a hinge mounting member mountable at the first component;

a hinge cup;

a hinge arm connected between the hinge mounting member and the hinge cup, wherein the hinge cup is mountable at the second component of the cabinet, is pivotally connected with respect to the hinge arm, and includes a receiving room;

at least one resilient member mounted in the receiving room of the hinge cup;

a retaining member engaged with the resilient member through an engaging feature, the retaining member including a channel;

a damper, the damper being mounted in the channel of the retaining member and corresponding to the hinge arm, wherein the damper includes a piston rod; and an adjusting member, wherein the adjusting member is movably mounted at the retaining member and includes a surface, a first contact portion, and a second contact portion, the first contact portion being spaced from the surface by a first distance, the second contact portion being spaced from the surface by a second distance, and the first distance being greater than the second distance;

wherein when the adjusting member is at a first position with respect to the retaining member, the first contact portion of the adjusting member corresponds to the piston rod of the damper such that, when the hinge cup is being closed with respect to the hinge arm and thereby drives the hinge arm to push and displace the damper, the piston rod of the damper is pressed against the first contact portion of the adjusting member to produce a first damping effect; and wherein when the adjusting member is at a second position with respect to the retaining member, the second contact portion of the adjusting member corresponds to the piston rod of the damper such that, when the hinge cup is being closed with respect to the hinge arm and thereby drives the hinge arm to push and displace the damper, the piston rod of the damper is pressed against the second contact portion of the adjusting member to produce a second damping effect.

13. The hinge of claim 12, wherein the resilient member and the engaging feature includes a first guiding section and a second guiding section respectively, and the first guiding section and the second guiding section work with each other to facilitate engagement of the retaining member with the resilient member.

14. The hinge of claim 13, wherein each of the first guiding section and the second guiding section is a curved or inclined surface.

15. The hinge of claim 12, wherein the adjusting member further includes a third contact portion, the third contact portion is spaced from the surface by a third distance, and the second distance between the second contact portion and the surface is greater than the third distance; and wherein when the adjusting member is at a third position with respect to the retaining member, the third contact portion of the adjusting member corresponds to the piston rod of the damper such that, when the hinge cup is being closed with respect to the hinge arm and thereby drives the hinge arm to push and displace the damper, the piston rod of the damper is pressed against the third contact portion of the adjusting member to produce a third damping effect.

16. A hinge, comprising:

a hinge cup including a receiving room;

a hinge arm pivotally connected with respect to the hinge cup;

at least one resilient member mounted at the hinge cup;

a retaining member mounted at the resilient member to shield at least a portion of the receiving room of the hinge cup, the retaining member including a channel; and a damper mounted in the channel of the retaining member and corresponding to the hinge arm.

17. The hinge of claim 16, wherein the retaining member is engaged with the resilient member through an engaging feature, the resilient member and the engaging feature include a first guiding section and a second guiding section respectively, each of the first guiding section and the second guiding section is a curved or inclined surface, and the first guiding section and the second guiding section work with each other to facilitate engagement of the retaining member with the resilient member.

18. The hinge of claim 16, wherein the resilient member provides a resilient closing force when the hinge cup is pivoted, and thereby closed, with respect to the hinge arm.

* * * * *